US007470144B2

(12) United States Patent
Murata et al.

(10) Patent No.: US 7,470,144 B2
(45) Date of Patent: Dec. 30, 2008

(54) STACKING CONNECTOR

(75) Inventors: Yoko Murata, Kawasaki (JP); Setsuo Kojima, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/000,469

(22) Filed: Dec. 13, 2007

(65) Prior Publication Data

US 2008/0153348 A1 Jun. 26, 2008

Related U.S. Application Data

(63) Continuation of application No. PCT/JP2005/010807, filed on Jun. 13, 2005.

(51) Int. Cl.
*H01R 3/00* (2006.01)

(52) U.S. Cl. ..... 439/489; 439/315

(58) Field of Classification Search ..... 439/315, 439/489

See application file for complete search history.

(56) References Cited

U.S. PATENT DOCUMENTS

| | | | | |
|---|---|---|---|---|
| 7,104,814 | B1 * | 9/2006 | She et al. | 439/131 |
| 7,198,522 | B1 * | 4/2007 | Ho et al. | 439/660 |

FOREIGN PATENT DOCUMENTS

| | | |
|---|---|---|
| JP | 4-35373 | 3/1992 |
| JP | 04-99680 | 8/1992 |
| JP | 6-72178 | 3/1994 |
| JP | 06-151006 | 5/1994 |
| JP | 06-275340 | 9/1994 |
| JP | 07-288157 | 10/1995 |
| JP | 09-245890 | 9/1997 |
| JP | 11-260484 | 9/1999 |
| JP | 3091617 | 7/2002 |
| JP | 2002-237359 | 8/2002 |

* cited by examiner

*Primary Examiner*—Truc T Nguyen
(74) *Attorney, Agent, or Firm*—Arent Fox LLP.

(57) ABSTRACT

A stacking connector has a first connector and a second connector respectively mounted on wiring boards and pressed against each other in a predetermined direction to be mated with each other, thereby electrically connecting the wiring boards. The first connector has a projection projecting in the same direction as the predetermined direction. The second connector has: a turning section that is turnable on a turning shaft disposed in a direction intersecting the predetermined direction, and having a first portion that enables turning of the turning section by being pressed by the projection when the first and second connectors are pressed against each other; and a wall section that conceals the turning section and has an opening formed therethrough at a position reached by a second portion of the turning section as a result of turning of the turning section when mating of the first and second connectors is completed.

2 Claims, 4 Drawing Sheets

STACKING CONNECTOR

CROSS-REFERENCE TO RELATED APPLICATION

This application is a continuation of Application No. PCT/JP2005/010807, filed Jun. 13, 2005, the entire specification claims and drawings of which are incorporated herewith by reference.

TECHNICAL FIELD

The present invention relates to a stacking connector having a first connector and a second connector mated with each other to establish electrical connections between wiring boards.

BACKGROUND ART

In today's societies, with the development of the semiconductor technique, various electronic devices such as computers and audio/video devices have been put to widespread use. Many of such electronic devices incorporate circuit boards on which electronic circuits having integrated circuits such as ICs and LSIs are mounted. The performance of such electronic circuits on circuit boards plays an important role in improving the performance of electronic devices and reducing the size of electronic devices.

In such electronic devices, connectors are provided to electrically connect electronic circuits on different circuit boards to each other and, at the time of connection, the connectors are mated with each other to establish electrical connections between the circuit boards. If the connectors are not completely mated to each other, a problem arises that a poor connection is caused or unmating is caused by a small shock.

Therefore, some connectors are provided with a mechanism having an indicator in the form of a projection which, when mating is performed, projects and appears out of a small opening provided on the connector, thereby a user performing a circuit board connecting operation is informed of the completion of mating (see, for example, patent documents 1 to 4).

Patent document 1: Japanese Patent Laid-Open No. 6-275340

Patent document 2: Japanese Utility Model Laid-Open No. 6-72178

Patent document 3: Japanese Patent Laid-Open No. 7-288157

Patent document 4: Japanese Patent Laid-Open No. 11-260484

DISCLOSURE OF THE INVENTION

Such connectors have a delicate mechanism for projecting the indicator in the form of a projection from a small opening simultaneously with mating by using an external force when mating is performed and, therefore, require a complicate construction in which component parts having complicated shapes are combined, and have an increased number of component parts.

In consideration of the above-described circumstances, an object of the present invention is to provide a stacking connector of a simple arrangement that allows checking of completion of mating.

A stacking connector of the present invention provided to achieve the above object has a first connector and a second connector respectively mounted on wiring boards and pressed against each other in a predetermined direction to be mated with each other, thereby electrically connecting the wiring boards, wherein:

the first connector has a projection projecting in the same direction as the predetermined direction; and the second connector has:

a turning section that is turnable on a turning shaft disposed in a direction intersecting the predetermined direction, and has a first portion that enables turning of the turning section by being pressed by the projection when the first connector and the second connector are pressed against each other, and a wall section that conceals the turning section and has an opening formed therethrough at a position reached by a second portion of the turning section as a result of turning of the turning section when mating of the first connector and the second connector is completed.

In the stacking connector of the present invention, the completion of mating can be checked with a markedly simple arrangement in which an indicator is turned when the connector is completely inserted.

In the stacking connector of the present invention, preferably, "the second portion of the turning section is colored in a color different from the color of the wall section."

In the stacking connector in such a form, it is easy to visually recognize that the indicator has been turned to the maximum extent and thus, the completion of insertion of the connector can be clearly recognized.

In the stacking connector of the present invention, the completion of mating can be checked with a simple arrangement.

BEST MODE FOR CARRYING OUT THE INVENTION

An embodiment of the present invention will be described with reference to the drawings.

A stacking connector according to the present embodiment has a connector having a recess and pins provided in the recess (hereinafter referred to as a male connector) and a connector having a raised portion and insertion sections which are provided in the raised portion and in which the pins of the male connector are respectively inserted (hereinafter referred to as a female connector).

Figure 1:
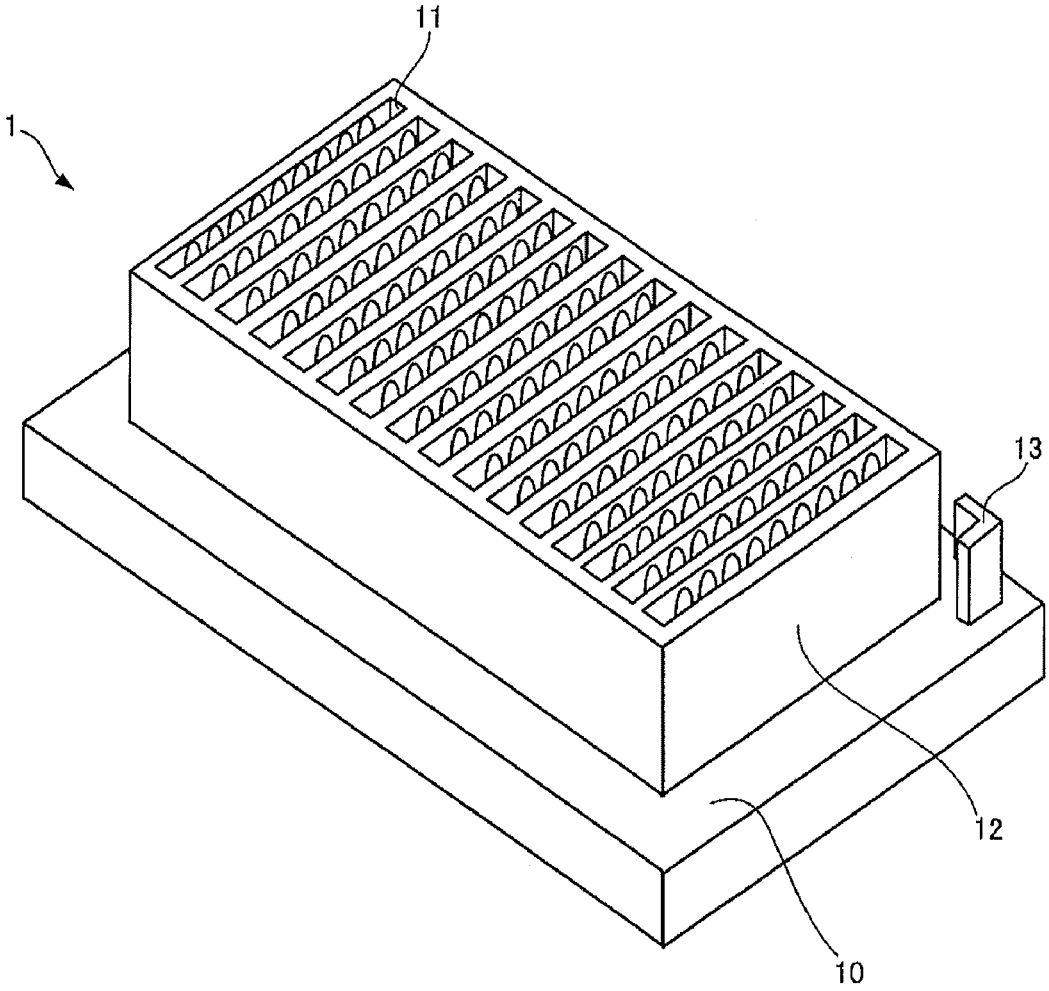
FIG. 1 is a diagram showing an appearance of a female connector in a stacking connector according to an embodiment.
Figure 2:
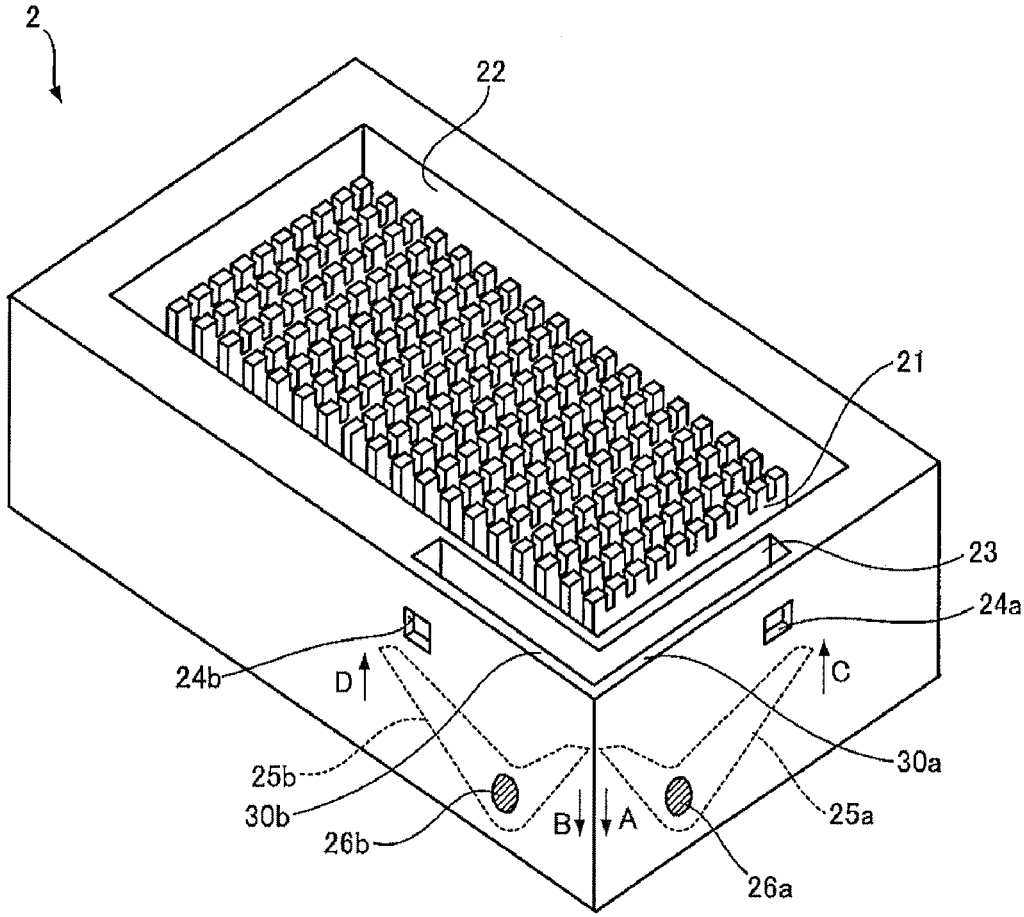
FIG. 2 is a diagram showing an appearance of a male connector in the stacking connector of the present embodiment.

FIG. 1 is a diagram showing an appearance of the female connector in the stacking connector according to the present embodiment. FIG. 2 is a diagram showing an appearance of the male connector in the stacking connector according to the present embodiment.

The female connector 1 shown in FIG. 1 and the male connector 2 shown in FIG. 2 are connectors respectively disposed on printed circuit boards mounted in an electronic device. The female connector 1 shown in FIG. 1 and the male connector 2 shown in FIG. 2 are mated with each other to electrically connect the printed circuit board on which the female connector 1 is disposed and the printed circuit board on which the male connector 2 is disposed. In this state, the stacking connector is interposed between the two circuit boards.

As shown in FIG. 1, the female connector 1 has a construction in which a raised portion 12 in the form of a rectangular block is provided on a connector base 10. The raised portion 12 has such a structure that partition plates are provided at equal intervals inside a box in the form of a rectangular block. Cells separated by the partition plates are insertion sections 11 in which pins 21 of the male connector shown in FIG. 2 are inserted. Electric wiring is laid on a bottom surface, not shown in the figure, of each of the insertion sections 11. This electric wiring is connected via an inner portion of the connector base 10 to an electronic circuit provided on the circuit board provided with the female connector 1.

As shown in FIG. 2, the male connector 2 has a recess 22, and the pins 21 to be inserted in the insertion sections 11 shown in FIG. 1 are provided inside the recess 22. Each pin is connected to electric wiring provided on a bottom surface of the recess not shown. This electric wiring is connected to an electronic circuit provided on the circuit board provided with the male connector 2.

The raised portion 12 of the female connector 1 shown in FIG. 1 is formed so as to be mated with the recess 22 of the male connector 2 shown in FIG. 2. At the time of mating therebetween, the pins 21 provided inside the recess 22 are respectively mated with the insertion sections 11 provided in the raised portion 12. By this mating of the female connector 1 and the male connector 2, the electronic circuit on the circuit board provided with the female connector 1 and the electronic circuit on the circuit board provided with the male connector 2 are electrically connected to each other.

If this mating is not completely performed, a problem may arise that a poor electrical connection is caused or unmating is caused by a small shock. To avoid the occurrence of such a problem, the female connector 1 and the male connector 2 have a mechanism for informing a person of the completion of mating. Components for realizing this mechanism and the functions of the components will be described below.

The female connector 1 shown in FIG. 1 has an L-shaped projecting portion 13 provided on the connector base 10 separately from the raised portion 12. On the other hand, the male connector 2 shown in FIG. 2 has an L-shaped insertion section 23 provided on an end portion on the periphery of the recess 22. A hollow extending downward in the direction from the top to the bottom of FIG. 2 is formed inside the L-shaped insertion section 23. In this hollow are provided turning sections 25*a* and 25*b* indicated by the dotted line in the figure, which respectively turn on turning shafts 26*a* and 26*b* along two side walls 30*a* and 30*b* externally covering the hollow.

The female connector 1 corresponds to an example of the first connector according to the present invention; the male connector 2 corresponds to an example of the second connector according to the present invention; and the side walls 30*a* and 30*b* correspond to an example of the wall section according to the present invention. Also, the projecting portion 13 corresponds to an example of the projection according to the present invention, and the turning sections 25*a* and 25*b* correspond to an example of the turning section according to the present invention.

When the female connector 1 is mated with the male connector 2, the projecting portion 13 enters the L-shaped insertion section 23 and presses ends of the two turning sections 25*a* and 25*b* in directions indicated by arrows A and B in the figure. The two turning sections 25*a* and 25*b* are thereby turned, so that the other ends of the turning sections 25*a* and 25*b* are turned in directions indicated by arrows C and D in the figure. If this mating is completely performed, portions of the two turning sections 25*a* and 25*b* turned in the directions indicated by the arrows C and D can be recognized through indicator window portions 24*a* and 24*b* respectively provided in the two side walls 30*a* and 30*b*. Turning of the turning section 25*a* shown in the right-hand side in the figure in the two turning sections 25*a* and 25*b* will be described below by way of example.

Figure 3:
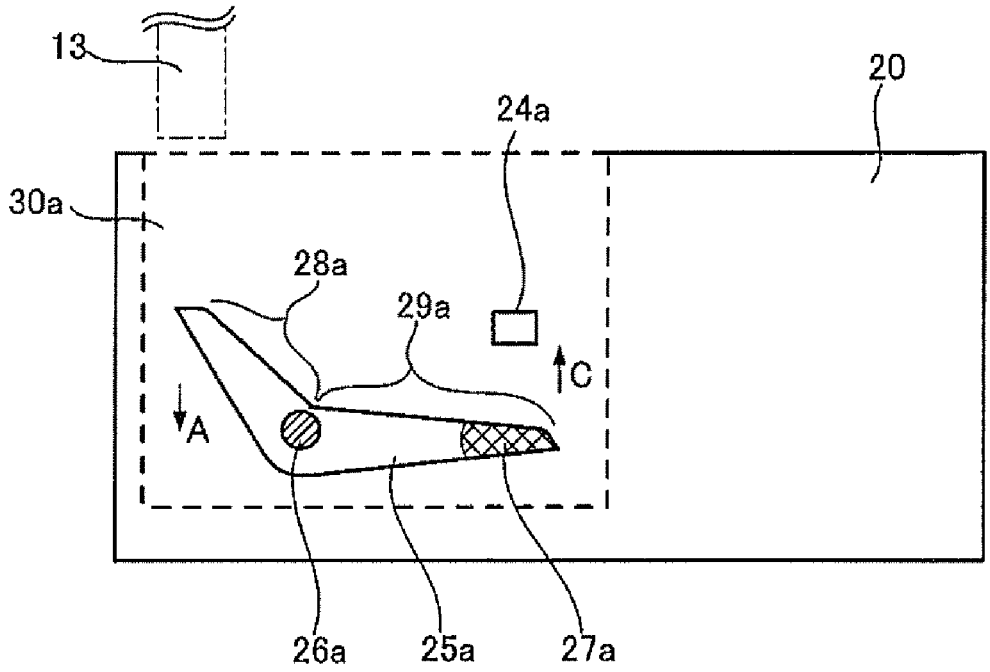
FIG. 3 is a sectional view along a side surface of the male connector shown in FIG. 2 before mating is performed.
Figure 4:
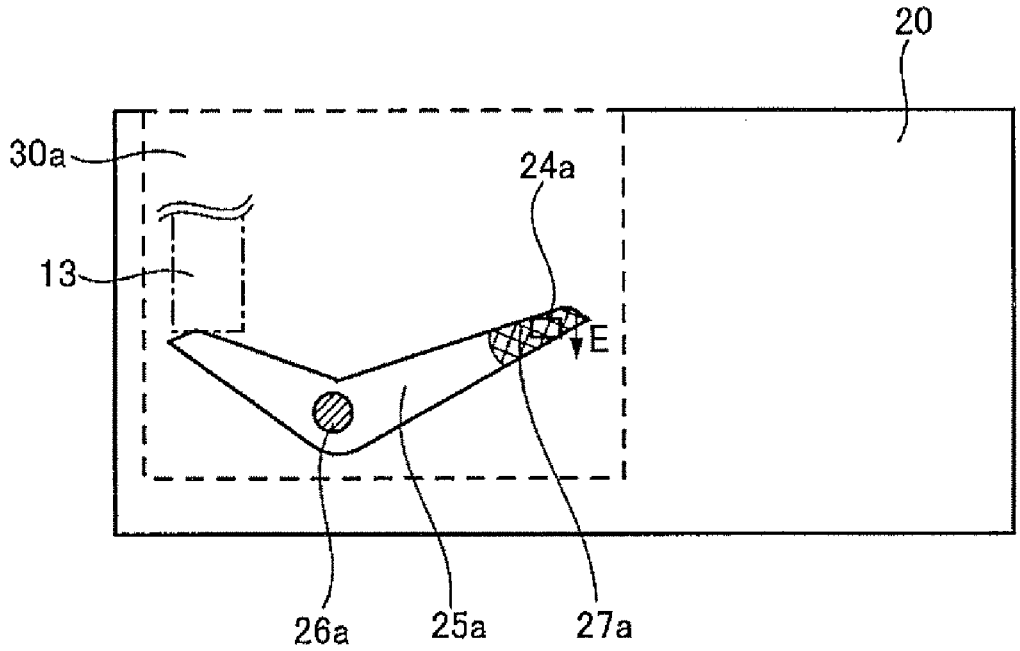
FIG. 4 is a sectional view along a side surface of the male connector when mating is completely performed.

FIG. 3 is a sectional view along a side surface of the male connector shown in FIG. 2 before mating is performed, and FIG. 4 is a sectional view along a side surface of the male connector when mating is completely performed.

In FIG. 3, a cross section of the L-shaped insertion section 23 is indicated by the dotted line. The turning section 25*a* shown in FIG. 2 is provided at the bottom of the insertion section 23. A central portion of the turning section 25*a* is turnably supported by the turning shaft 26*a* extending perpendicular to this figure. As shown in the figure, a portion 29*a* of the turning section 25*a* on the right-hand side of the turning shaft 26*a* (hereinafter referred to as a right portion) is larger and heavier than a portion 28*a* on the left-hand side of the turning shaft 26*a* (hereinafter referred to as a left portion). Before mating is performed, therefore, the right portion 29*a* of the turning section 25*a* takes a horizontally laid attitude along the bottom of the insertion section 23, while the left portion 28*a* of the turning section 25*a* takes a leftward leaning attitude.

When mating is performed, the projecting portion 13 indicated by the dot-dash line in the figure is inserted from above to be brought into contact with the left portion 28*a* of the turning section 25*a*, thereby pressing the left portion 28*a* in the direction indicated by arrow A. As a result, the right portion 29*a* of the turning section 25*a* is turned in the direction indicated by arrow C. FIG. 4 shows a state in which, mating is completely performed and the projecting portion 13 deeply enters the insertion section 23 to the maximum extent, and the right portion 29*a* of the turning section 25*a* is turned upward (in the direction indicated by arrow C of FIG. 3) to the maximum extent. A tip end portion 27*a* of the right portion 29*a* is colored in yellow. When the right portion 29*a* is turned upward (in the direction indicated by arrow C of FIG. 3) to the maximum extent, the tip end portion 27*a* colored in yellow appears through the indicator window portion 24*a* provided in the side surface of the male connector 2 to be recognized externally with the human eyes. Therefore, even in a state of being interposed between the two circuit boards, mating of the connector can be easily checked. The color of the whole of the recess 22 is white, and the tip end portion 27*a* colored in yellow is conspicuous in contrast with the surrounding white color of the recess 22, so that the tip end portion 27*a* can be clearly recognized with the human eyes. In a state shown in FIG. 3 before mating is performed, or in a state where the right portion 29*a* of the turning section 25*a* is not turned upward to the maximum extent due to incomplete mating, the tip end portion 27*a* is not recognized through the indicator window portion 24*a*. It is, therefore, possible to accurately determine the completion of mating when the tip end portion 27*a* is recognized through the indicator window portion 24*a* as described above. In the above, the opening surrounded by the indicator window portion 24*a* or 24*b* is an example of the opening according to the present invention.

When the female connector 1 and the male connector 2 are dissociated from each other, the projecting portion 13 shown in FIG. 4 is disengaged, the right portion 29*a* of the turning section 25*a* turns in a direction indicated by arrow E in FIG.

4 due to weight balance, and the turning section 25*a* again returns to the position shown in FIG. 3.

The above is a description of the embodiment of the present invention.

Thus, in the above-described stacking connector having the female connector 1 and the male connector 2, the completion of mating of the connectors can be checked with a simple arrangement.

While the turning sections 25*a* and 25*b* in bent form are used in this stacking connector, the shape of the turning sections in the connector according to the present invention is not limited to such a shape and may be in any shape as long as the turning sections turn on the turning shafts serving as the fulcrum of leverage. For example, the turning section may be a turning section in the form of a rod which turns on a turning shaft provided as the fulcrum of leverage.

What is claimed is:

1. A stacking connector comprising a first connector and a second connector respectively mounted on wiring boards and pressed against each other in a predetermined direction to be mated with each other, thereby electrically connecting the wiring boards, wherein:

the first connector has a projection projecting in the same direction as the predetermined direction; and the second connector has:

a turning section that is turnable on a turning shaft disposed in a direction intersecting the predetermined direction, and has a first portion that enables turning of the turning section by being pressed by the projection when the first connector and the second connector are pressed against each other, and a wall section that conceals the turning section and has an opening formed therethrough at a position reached by a second portion of the turning section as a result of turning of the turning section when mating of the first connector and the second connector is completed.

2. The stacking connector according to claim 1, wherein the second portion of the turning section is colored in a color different from a color of the wall section.

* * * * *